US005517707A

United States Patent [19]

LaMantia

[11] Patent Number: 5,517,707

[45] Date of Patent: May 21, 1996

[54] CRIB COVER SECURING DEVICE

[76] Inventor: Mark A. LaMantia, 5 Flair Oaks Ave., Methuen, Mass. 01844

[21] Appl. No.: 284,091

[22] Filed: Aug. 1, 1994

[51] Int. Cl.[6] ..... A47C 29/00; A47D 7/00

[52] U.S. Cl. ..... 5/97; 24/563; 24/459; 135/96

[58] Field of Search ..... 5/97, 414; 135/96, 135/90; 24/563, 459, 460

[56] References Cited

U.S. PATENT DOCUMENTS

| | | | |
|---|---|---|---|
| 1,021,930 | 4/1912 | Jackson | 5/414 |
| 2,820,468 | 1/1958 | Park et al. | 5/97 |
| 2,883,678 | 4/1959 | Heffernan et al. | 5/97 |
| 2,927,331 | 3/1960 | Ruiz | 5/97 |
| 3,546,721 | 12/1970 | Cleary | 5/97 |
| 4,015,297 | 4/1977 | Christian | 5/97 |
| 4,043,349 | 8/1977 | Gays et al. | 5/97 |
| 4,073,017 | 2/1978 | Stevens | 5/97 |
| 4,590,956 | 5/1986 | Griesenbeck | 135/116 |
| 4,694,516 | 9/1987 | Overman, Sr. et al. | 5/97 |
| 4,745,936 | 5/1988 | Scherer | 135/127 |
| 4,790,340 | 12/1988 | Mahoney | 5/414 |
| 4,945,584 | 8/1990 | LaMantia | 5/97 |

*Primary Examiner*—Alexander Grosz
*Attorney, Agent, or Firm*—Wolf, Greenfield & Sacks

[57] ABSTRACT

A clip for securing a cover to a crib or playpen includes a first loop for providing a snap-fit onto the top bar of the crib, a cavity for holding a side rod of the cover, and an extension for guiding the clip onto the crib or playpen.

10 Claims, 4 Drawing Sheets

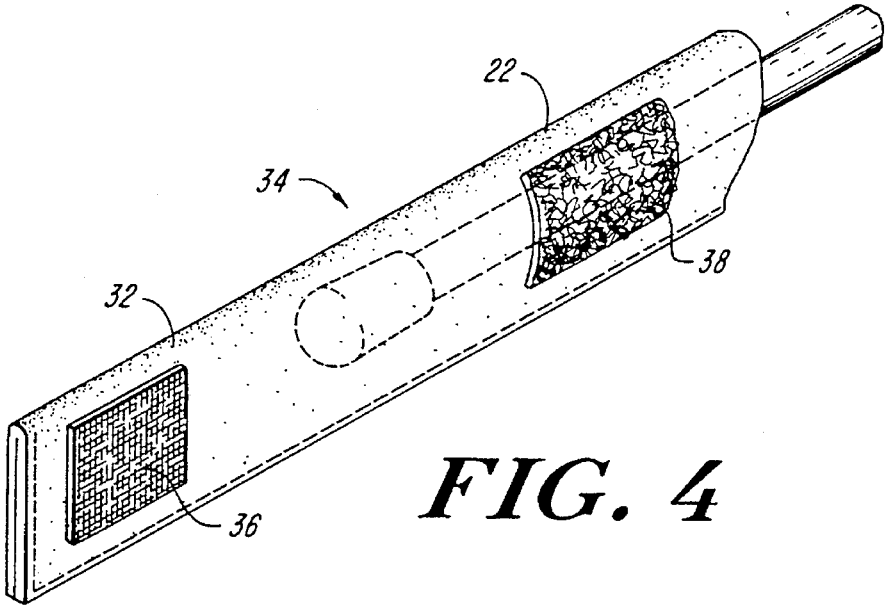
FIG. 4
FIG. 5A
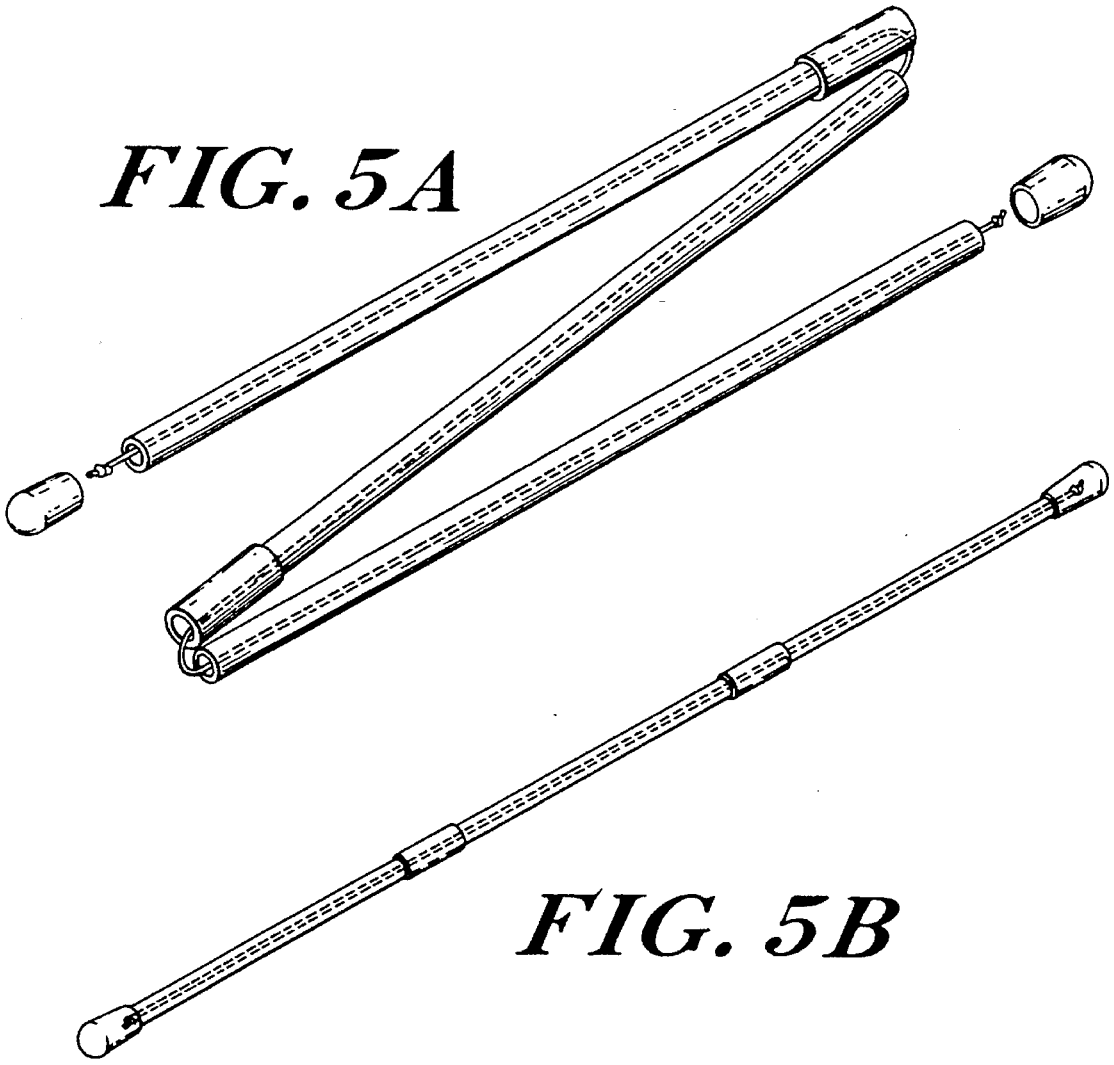
FIG. 5B

CRIB COVER SECURING DEVICE

FIELD OF THE INVENTION

This invention relates to a means for securing crib covers or canopies to cribs, playpens, or other similar enclosures for infants and children. More particularly, the present invention relates to a snap-fit clip for simply and quickly securing and disassembling a cover to a crib.

BACKGROUND OF THE INVENTION

Infants and children generally spend a large amount of time in pen-like structures. Because it is not practical to supervise a child in one of these structures continually, a number of safety devices has been developed to prevent the child from climbing or falling out the pen-structure and sustain an injury. Along with these devices came a series of means to secure the cover element to the crib. For example, U.S. Pat. No. 4,945,584, by the present inventor, discloses a series of ties for securing the canopy to the crib. Each tie must be separately knotted to sufficient strength to prevent a child from undoing the ties or from the ties loosening by themselves. The patent also discloses the use of Velcro closures for this purpose.

Other devices have been provided to secure a cover to a crib. Among those devices include U.S. Pat. No. 2,883,678 issued to Heffernan which discloses the use of a buckle/strap arrangement for securing a cover to a crib. U.S. Pat. No. 2,927,331 to Ruiz describes use of fabric loops which are secured to the corner posts of the crib. The Ruiz system does not provide the necessary security for an strong or determined child because there is substantially no means to prevent the child from squeezing between the canopy and the top rail at positions between the corner posts. U.S. Pat. No. 3,546,721 issued to Cleary discloses a securing system having a cord which is looped in a laced configuration through the canopy and along the side arms and top bar of the crib. While this system is secure, the time involved in lacing the canopy onto the crib is substantial. Finally, clamps have been shown as a means to maintain a canopy in position as discussed in U.S. Pat. No. 4,043,349 issued to Gays.

None of the prior art devices known to the inventor provide for a simple, fast, and secure attachment of a child's crib cover to a crib. The desired design should also secure the canopy to the crib to prevent the canopy to the crib to prevent loosening during use.

SUMMARY OF THE INVENTION

It is therefore an object of the present invention to provide a means for securing a canopy to a pen-like structure such as a play pen or crib which may be easily removed or secured in position by an adult while not being readily removed by a child.

It is a further object of the present invention to provide a clip for securing the canopy to a play pen or crib which will not injure a curious child playing with the secured clips.

It is still a further object of the present invention to provide a clip which is simple and cheap to manufacture.

According to the present invention, the means for securing the canopy to the pen-like structure is a question mark-shaped clip having a substantially enclosed loop with a small nub radially extending from one end thereof and a larger extension running downward from the other end of the loop. The clip is passed through the canopy and is snapped onto the structure. Within the circumference of the loop portion is a second smaller cavity in which the canopy rod is secured.

These and other objects and features of the present invention will be better understood and appreciated from the following detailed description of one basic embodiment thereof, selected for the purpose of illustration and shown in accompanying drawings, in which:

BRIEF DESCRIPTION OF THE DRAWINGS

FIG. 4 is a fragmentary view of one end of the sleeve and one rod showing details of the sleeve closure;

FIGS. 5A and 5B are perspective views of a shock cord rod in the collapsed and erect positions, used in the frame of the canopy fabric;

DETAILED DESCRIPTION OF THE DRAWINGS

Figure 1:
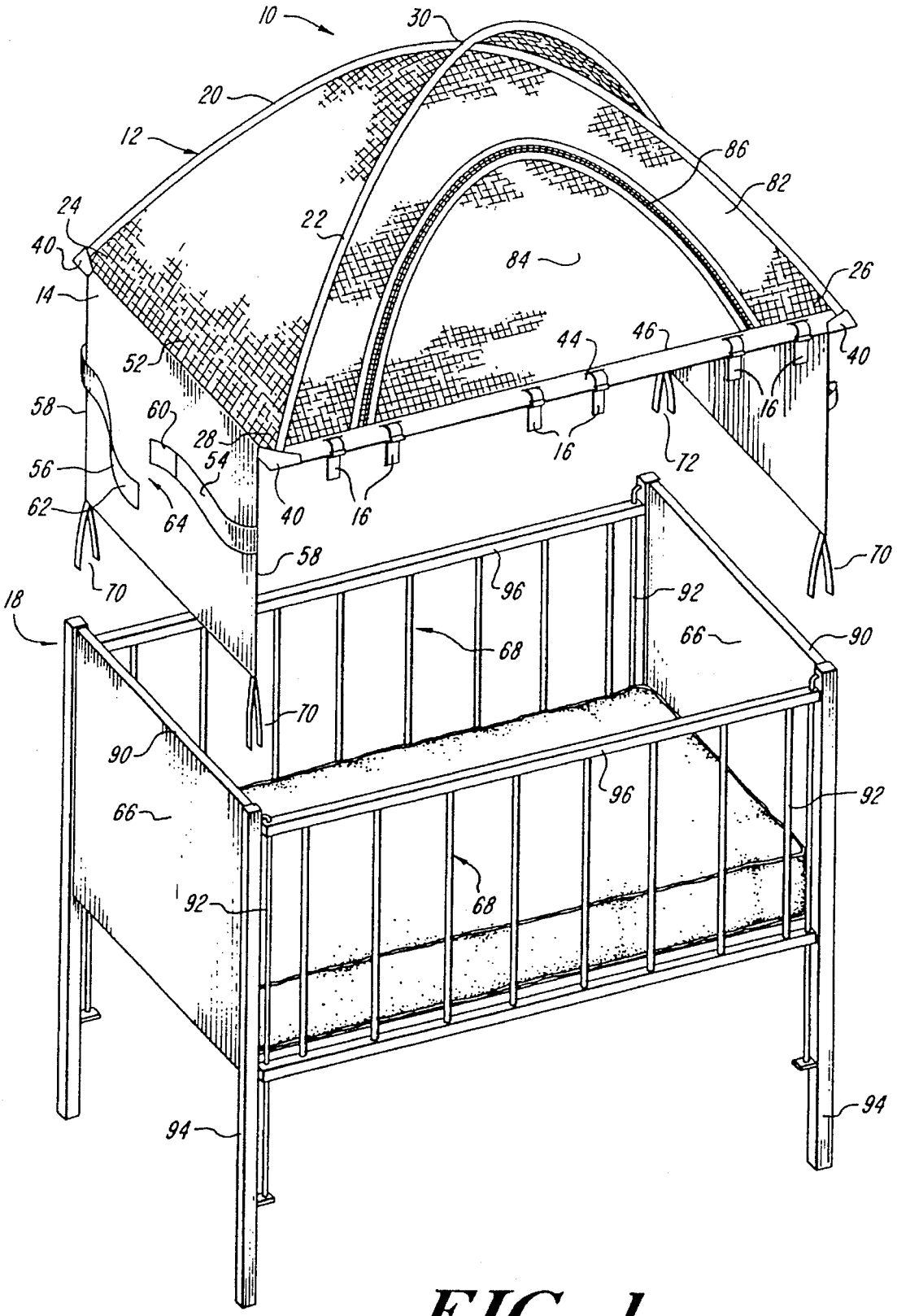
FIG. 1 is a perspective view of the crib and crib cover showing the present invention as positioned just prior to attachment to a crib.

The crib cover 10 shown in the drawings includes a canopy 12, panels 14, and clips 16 as its major components. The basic crib cover and crib arrangement are the subject of U.S. Pat. No. 4,945,584 issued Aug. 7, 1990 to the present inventor and is incorporated herein by reference. The description of the canopy and the crib in U.S. Pat. No. 4,945,584 and the equivalents thereof may be used in conjunction with this invention.

The crib cover 10 is particularly shaped in the embodiment illustrated to be used with a conventional crib 18 which typically is approximately 2½×4½ feet in plan dimensions. In the preferred embodiment, the canopy 12 is made of a loosely woven fabric or a net material such as six hole polyester netting, which allows for free passage of air, light and sound, and which is effectively transparent so that the child may be easily viewed through it when the tent cover is in place. It will, of course, be appreciated that the shape and dimensions of the canopy may be varied to accommodate cribs of other sizes or to be used with playpens or other open top furniture in which infants and toddlers are regularly kept.

The canopy 12 is generally dome-shaped, and a pair of sleeves 20 and 22 which typically may be made of woven pack cloth are stitched to the outside surface of the canopy fabric and extend across the entire fabric from opposite corners. Sleeve 20 is shown to extend between corners 24 and 26 of the canopy while sleeve 22 extends between corner 28 and the fourth corner which is not visible in the perspective views of the drawing. The sleeves 20 and 22 cross at the apex 30 of the canopy, but the stitching securing the sleeves to the fabric does not interrupt the openings extending through the sleeves so that rod-like members may be inserted through the sleeves from one end to the other.

The canopy fabric which is not self-supporting is supported in the dome-like configuration shown by a pair of conventional shock cord rods that extend through the sleeves 20 and 22 from end to end. One shock cord rod is shown in detail in FIG. 5. While shock cord rods are preferable because they may be collapsed for ease of storage or carrying when the crib cover is disassembled, it is evident that continuous one-piece rods may be used to support the canopy cover.

The ends of the sleeves 20 and 22 are open, and each end carries a flap 32 as shown in FIG. 4 which is designed to be folded back upon the sleeve to close the opening. To secure the flap in the closed position shown in FIG. 3, a Velcro closure 34 is provided with mating male and female patches 36 and 38 of the Velcro on the flap and sleeve. The flaps 32 are designed to capture the rods in the sleeve and retain the rods in place when the crib is assembled.

Figure 3:
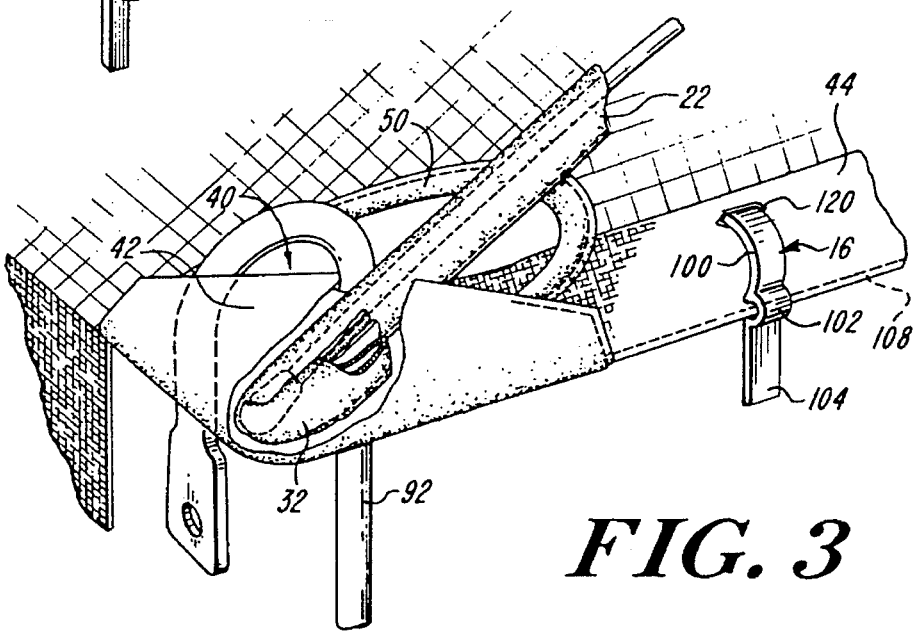
FIG. 3 is an enlarged perspective fragmented view of a support rod and related canopy structure and showing the manner in which the rod is retained in position.

A pocket 40 is also formed at each corner of the canopy. The pocket is defined by a generally triangular fabric 42 which may be integral with the panels 14 or the edge fabric 44 stitched to the long side edges 46 of the canopy. The panels 14, edge fabric 44 and pocket fabric 42 may also be made of woven pack cloth. The ends of the sleeves 20 and 22 extend into the pockets 40 so that the pockets serve as boots for the ends of the sleeves and the rods contained in them. Access to the interior of the pocket 40 and the ends of the sleeves 20 and 22 is facilitated by the circular cut-outs 50 provided at the four corners of the canopy, one of which is shown in FIG. 3.

The side panels 14 form extensions of the canopy fabric along its shorter edges 52. The panels 14 carry a pair of straps 54 and 56 stitched or otherwise secured to the side edges 58 of the panels as is clearly evident in FIGS. 1 and 2. The free ends of the straps 54 and 56 carry mating patches 60 and 62 of a Velcro closure 64 so that the straps 54 and 56 may be secured together on the outside of the closed end panels 66 of crib 18 as is more fully described below in connection with the assembly and use of the crib cover. The panels are not normally provided when the canopy is used on a play pen.

Figure 2:
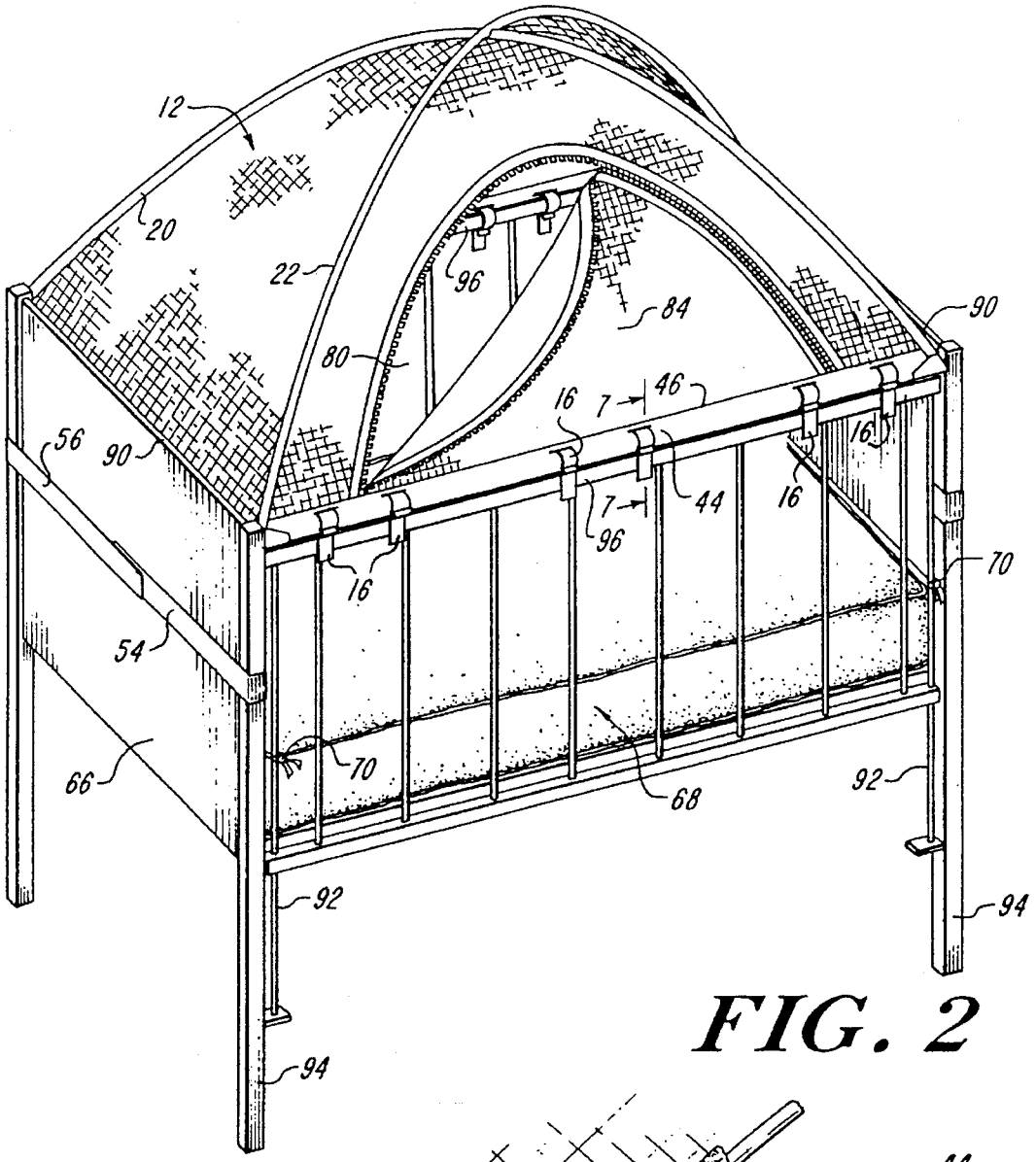
FIG. 2 is similar to FIG. 1 but showing the canopy attached to the crib and further showing the means for accessing the interior of the canopy structure.

The clips 16 are spaced along the edge fabric 44 on each long side of the canopy 12. The clips 16 secure the canopy 12 to the top bars 96 of the side rails 68 of the crib 18 as shown in FIG. 2. The clips are preferably made from a hard plastic, sufficiently bendable to provide a snap-fit arrangement over the top bars 96.

Figure 6:
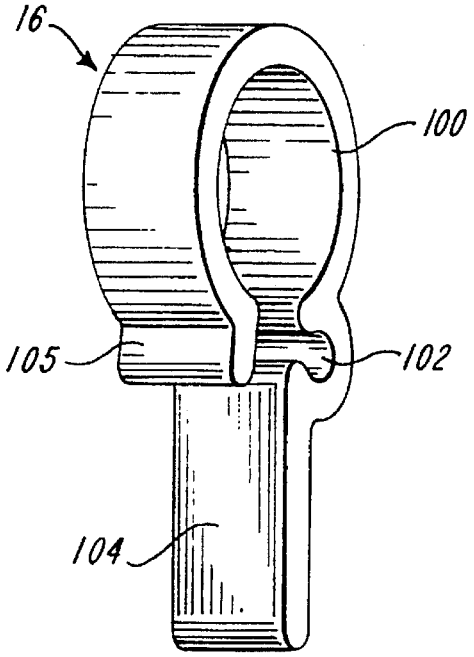
FIG. 6 is a perspective view of the preferred embodiment of the present invention.
Figure 7:
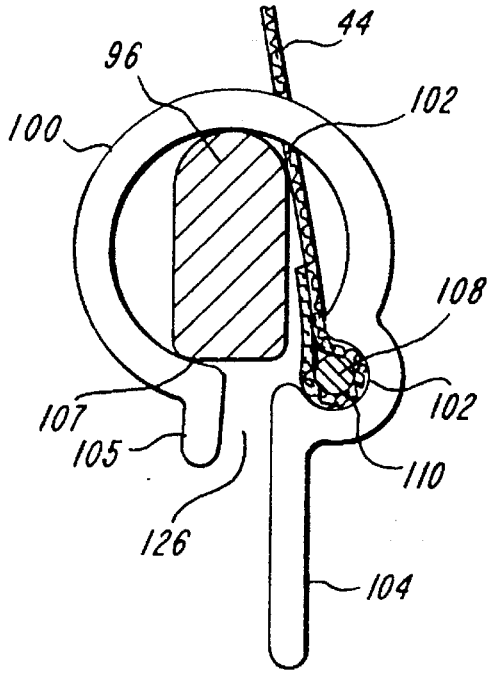
FIG. 7 is a cross-section view of the present invention taken along the line 7—7 of FIG. 2.

The clips 16, as best illustrated in FIGS. 6 and 7, are shaped like a question mark. Each clip 16 has a substantially enclosed loop portion 100 and a length 104 running downward from one end of the loop 100. The clip 16 also has a smaller secondary loop or cavity 102 formed along the edge of loop portion 100 proximal to the length 104 and a nub 105 extending radially from the other end of the loop portion 100. The smaller secondary loop or cavity 102 as shown is partially disposed within the main loop portion 100. The diameter of the loop 100 should be approximately equal to the height of the top bar 96. In fact, a portion 107 of the loop 100 proximate to the opening 126 should extend below and abut the underside of the top bar 96 when secured in position. The clip 16 should fit snugly in position so that the child will not catch his or her fingers if playing with the clips 16. Also, a snug fit mitigates movement of the canopy when positioned on the crib.

The small cavity 102 should be sized to tightly receive a rod 108. The rods 108 extend along each long side of the canopy 12 and are housed within the edge fabric 44. The rods 108 and the portions of the fabric 110 which encircles them, are secured within the cavity 102 of the clips 16.

When securing the canopy 12 to the crib 18 or play pen, the clips 16 are partially passed through small button-type holes 120 in the fabric of the canopy 12 as shown in FIG. 3. The clips touch the edge of the hole 120 along the loop portion 100. Next, the rod 108 is pressed into the cavity 102 of each clip 16. Finally, using the length 104 as a guide, the clips 16 are pushed downward and snapped onto the top bar 96. As the top bar 96 passes between the length 104 and the nub 105, the opening 126, as defined by each end of the loop 100, increases to accommodate the top bar 96 until the bar 96 snaps into position. As mentioned above, the portion 107 of the loop 100 should engage the underside of the top bar 96. Finally, when removing the clips 16 from the top bar 96, the length 104 may be used as a gripping surface to enlarge the opening 126 and to remove the top bar 96 by pulling the clips 16 over the bar 96.

A pair of additional ties 70 are secured to the lower corners of each panel 14. These ties may be used in a variety of different ways to secure the lower ends of the panels in place when the erected cover is mounted on the crib. As mentioned above, the panels are not normally used when the cover is used.

The cover is completed by a large opening 80 in one side 82 of the cover fabric. The opening 80 is closed by a flap 84 preferably made of the same material as the canopy, which may be secured in the closed position by zipper 86 that extends fully about the mating arcuate edges of the canopy fabric and the flap.

When the zipper is closed, the flap 84 forms a part of the side wall 82 of the canopy so that it is essentially uninterrupted. However, when the zipper 86 is opened, the flap 84 may conveniently be folded to the outside of the rail 68 so as to provide a very large and convenient opening for access to the interior of the crib or play pen. The infant or toddler may readily be lifted from or placed in the crib or play pen through the opening 80.

The cover of the present invention is assembled as follows: First, the shock cord rods are assembled, and each is inserted into one of the sleeves 20 and 22. The rods will flex and assume a bowed configuration when they are both contained in their sleeves because of the domed shape of the canopy fabric. The flaps 32 at the end of each sleeve are then folded over the open ends of the sleeve and are secured in the folded position by the Velcro closures 34. The closed sleeves containing the rods are then placed in the pockets 40 to maintain the rods in the flexed state so that they support the canopy in the dome configuration and maintain tension on the canopy fabric.

After the canopy is erected, it is placed on the top of the crib 18 resting on the top bars 96 of side rails 68 and with the panels 14 disposed against the inside surfaces of the end walls. The canopy preferably is slightly shorter and slightly wider than the crib frame so that it fits readily on top of the rails in that position. The circular openings 50 permit the canopy to sit on the bars 96 without interference from the vertical rods 92 on which the rails 68 are mounted.

The ties 70 at the bottoms of the panels 14 may be secured to the lower ends of the vertical rods 92 mounted on the crib legs 94 and which slidably support the crib side rails 68. With the panels 14 disposed on the insides of the end walls 66, straps 54 and 56 may be pulled about the outside of the end walls 66 and their Velcro closures 64 may be secured together so as to securely hold the end panels in place. Thereafter, the clips 16 may be secured to the top bars 96 of the side rails 68 as suggested in FIG. 2.

It will be appreciated that when the cover is assembled and mounted on the play pen in the manner described, it provides with the play pen itself a total enclosure for the infant or toddler, which will deter the toddler from climbing out of or falling from the crib. While the child is confined, he, nevertheless, may easily be watched for the canopy fabric is essentially transparent. And a window may be provided in the canopy if desired to further facilitate viewing of the child. Furthermore, the canopy does not in any way interfere with the free flow of air through the play pen or crib. The open side rails also remain exposed for the free circulation of air and easy viewing of the child. While the child is safely retained in the crib or play pen by the cover, the child may readily be removed from it by merely opening the zipper 86 and folding the flap 84 downwardly on the outside of side rail 68 so as to expose the opening 80 in the canopy fabric. The opening is large enough so that the person attending the child may easily lean into the crib or play pen and/or extend both arms into it so as to attend to the child.

While in the foregoing description but a single embodiment of the invention has been illustrated and described, it will be appreciated that numerous modifications may be made of the invention without departing from its spirit. Therefore, it is not intended that the scope of the invention be limited to that single embodiment. Rather, its scope is to be determined by the appended claims and their equivalents.

I claim:

1. A clip for securing a safety canopy to a child's crib or play pen having end walls and at least two vertically slotted side walls with top bars, comprising:

a first portion for releasably securing the clip in a snap-fit arrangement to the crib or playpen; and a second portion at least partially disposed within said first portion for releasably securing the canopy to said clip.

2. The clip as set forth in claim 1, wherein said second portion secures the canopy therein in a snap-fit arrangement.

3. The clip as set forth in claim 2, wherein said first portion is a loop shaped to engage a top bar and having a diameter substantially equal to a height of a top bar.

4. The clip as set forth in claim 2 further including a guide element extending from one side of said first portion for guiding said clip onto the top bar and for providing a finger engagement mechanism for releasing said top bar from within said loop.

5. The clip as set forth in claim 4, wherein said clip resembles a question mark.

6. A clip for securing a safety canopy to a child's crib or play pen having end walls and at least two vertically slotted side walls with top bars, comprising:

an engagement end having means for securing the clip to the crib or play pen and to the canopy, said engagement end including a first upper loop for engagement of the crib or play pen and a second cavity portion for engagement of the canopy; and a length extending from said engagement end for releasably securing said engagement end with the crib or play pen.

7. The clip as set forth in claim 6, wherein said first upper loop forms a first snap-fit arrangement for securing the crib or play pen therein and said second cavity forms a snap-fit arrangement for securing the canopy therein.

8. The clip as set forth in claim 7, wherein said second cavity is at least partially disposed along said first upper loop.

9. The clip as set forth in claim 7, wherein said length provides means for guiding said first upper loop over said crib or play pen.

10. The clip as set forth in claim 9, wherein said clip resembles a question mark.

* * * * *